United States Patent [19]

Kollegger

[11] Patent Number: 4,823,468

[45] Date of Patent: Apr. 25, 1989

[54] TOOL FOR CENTER-PUNCHING AND SCRIBING WORKPIECES

[76] Inventor: Martin Kollegger, Stredas 12, CH-7500, St. Moritz, Switzerland

[21] Appl. No.: 55,094

[22] Filed: May 28, 1987

[30] Foreign Application Priority Data

Jun. 3, 1986 [CH] Switzerland ..... 2236/86

[51] Int. Cl.[4] ..... B26F 1/00

[52] U.S. Cl. ..... 30/368; 30/360

[58] Field of Search ..... 30/358, 360, 366, 367, 30/368, 164.9; 33/579, 673; 408/72 R, 72 B, 115 B

[56] References Cited

U.S. PATENT DOCUMENTS

| | | | |
|---|---|---|---|
| 1,541,078 | 6/1925 | Sudweeks | 30/366 |
| 1,563,574 | 12/1925 | Jensen | 30/358 |
| 2,595,347 | 5/1952 | Flemming | 30/368 X |
| 2,795,052 | 6/1957 | Felenchak | 30/368 X |
| 3,791,034 | 2/1974 | Carver | 30/367 |
| 4,069,586 | 1/1978 | Skelton | 30/360 |
| 4,087,912 | 5/1978 | Granone | 30/366 |

*Primary Examiner*—Douglas D. Watts
*Assistant Examiner*—Michael D. Folkerts
*Attorney, Agent, or Firm*—Pollock, Vande Sande & Priddy

[57] ABSTRACT

A tool which has spacer sleeves displaceable on a center punch and hollow shafts are adjacent to one another is intended for rapidly and precisely finding the center of holes and the longitudinal center of slots and channels, so that center marks and linear scribes can be made. The spacer sleeves and the hollow shafts have different diameters, and the hollow shafts are inserted one into the other in telescopic form. When a hollow shaft is fittingly inserted into hole (5) or slot (5) the center of the former or the longitudinal center of the latter can reliably be found by the center punch for making center marks or linear scribes in the slots. The tool can also be used for producing center marks on shafts and pins.

6 Claims, 2 Drawing Sheets

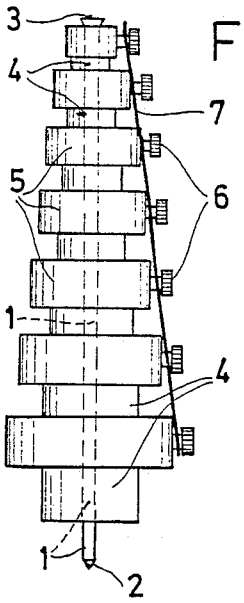
Fig.7
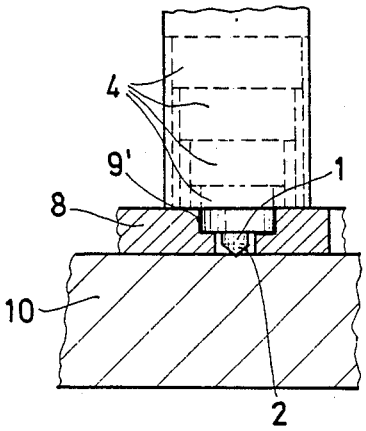
Fig.8
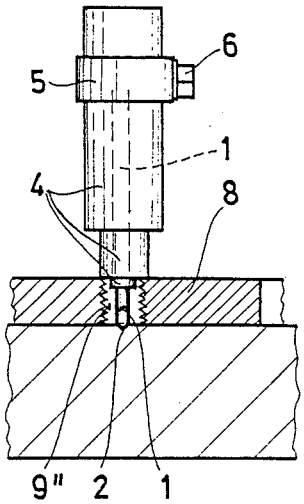
Fig.9
Fig.10
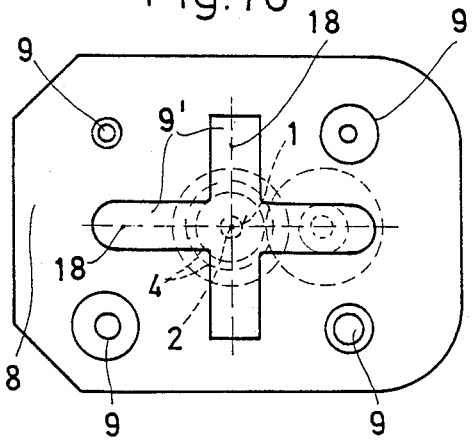
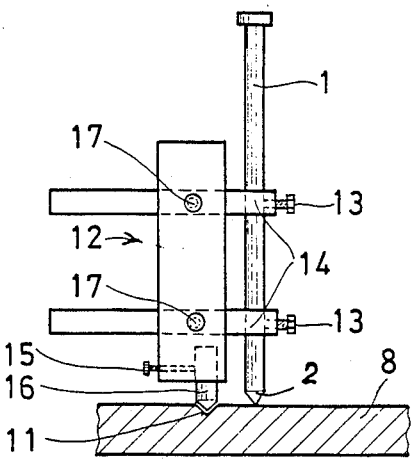
Fig.11
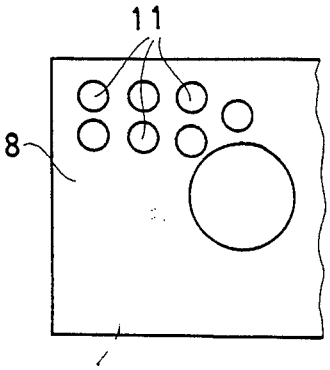
Fig.11a

TOOL FOR CENTER-PUNCHING AND SCRIBING WORKPIECES

BACKGROUND OF THE INVENTION

Point-like or linear marks are made in the surface of a workpiece of metal, wood or plastic by means of a center punch of hard metal. Marks and center marks in holes or on shafts and linear scores for scribing purposes in slot-like depressions are very time-consuming to carry out with precision and require manual skill, since it is difficult rapidly and precisely to determine the center of holes or the longitudinal center of slots and grooves; for this reason, errors frequently occur. It is also inconvenient to remove a broken screw from a workpiece. The broken screw present in the workpiece has to be drilled out, and it is generally only in exceptional cases that the center for positioning a drill bit for drilling out can be determined exactly. Where the operation is carried out imprecisely, the screw thread in the workpiece is damaged when the broken screw is drilled out, any repaired screw connection becomes insecure, and the new screw does not fit. The only remaining remedy is to cut a new thread in the workpiece and to use an appropriate screw. Rapid centering, for example on a screw, likewise dispenses with the inconvenient procedure of clamping in the lathe.

OBJECTS OF THE INVENTION

The invention relates to a tool for center-punching and scribing workpieces. The object of the invention is to find reliably the center of any cylindrical, conical or stepped holes or the longitudinal center of slots, including those on shafts, in order to make point-like or linear marks in a workpiece surface. Rapid and easy centering on a screw, a pin or a shaft furthermore makes it possible to dispense with the inconvenient procedure of clamping in a lathe.

This object is achieved, according to the invention, by the features claimed in the appended claim 1. Further advantageous embodiments are described in the dependent claims 2 to 6.

Embodiments of the invention are described with reference to the drawing; in particular:

DESCRIPTION OF THE DRAWINGS

FIG. 7 shows a longitudinal side view in which the spacers are pulled apart from one another and the hollow shafts are pushed into one another, before the tool is positioned on the workpiece, FIG. 8 shows a partial view based on FIG. 5, the lowermost hollow shaft being inserted with a good fit into a stepped hole in the workpiece, FIG. 9 shows a partial view as in FIG. 8, once again with the lowermost hollow shaft inserted into a threaded hole, FIG. 10 shows a workpiece with two intersecting slots and holes of various dimensions, FIG. 11 shows a partial view of the tool with a distance adjuster for making groups of marks in the workpiece, and FIG. 11*a* shows a pattern produced on a workpiece with the aid of the distance adjuster shown in FIG. 11, the said pattern consisting of depressions.

DETAILED DESCRIPTION OF THE INVENTION

Figure 1:
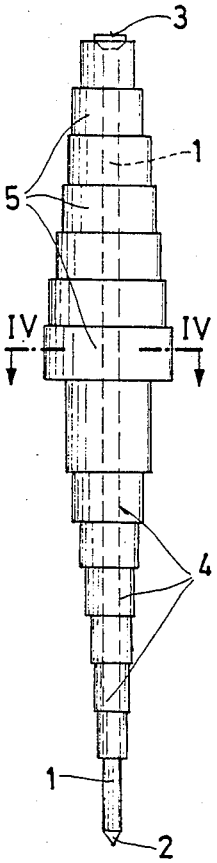
FIG. 1 shows a longitudinal side view of a first embodiment of the tool in the ready state.
Figure 2:
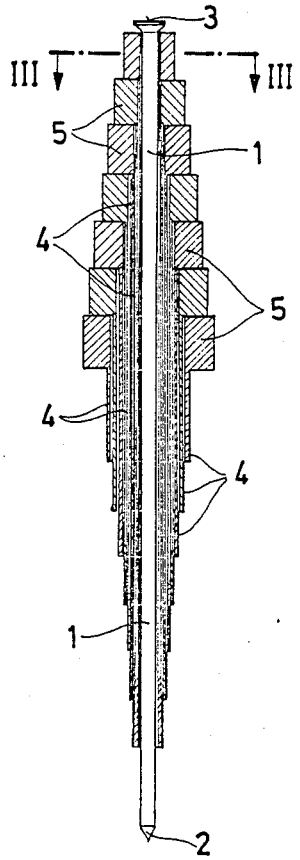
FIG. 2 shows a longitudinal section.
Figure 3:
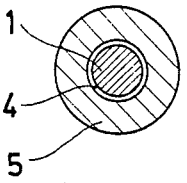
FIG. 3 shows a cross-sectional view through the line III—III in FIG. 2.
Figure 4:
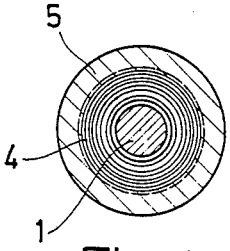
FIG. 4 shows a cross-section through the line IV—IV in FIG. 1.

1 denotes a center punch which consists of a hard metal and is provided at one end with a tip 2 and at the other end with a striking head 3. A center punch about 7 cm long and about 2–3 mm thick is suitable for normal use. A group of telescopic, displaceable hollow shafts 4 which consists of a plurality of pieces is mounted on the center punch 1. However, more or less than 7 hollow shafts can be used, depending on the type of application. A spacer sleeve 5 is present at the upper end of each hollow shaft 4. The spacer sleeves have different widths and diameters. The hollow shafts 4 and the spacer sleeves 5 each consist of one piece, but they may furthermore be single parts which are connected to one another by welding or which have been shaped from one piece. The diameters of the hollow shafts 4 increase from bottom to top in steps of about 1 mm, whereas the diameters of the spacer sleeves 5 increase from top to bottom by about 1 mm.

Figure 5:
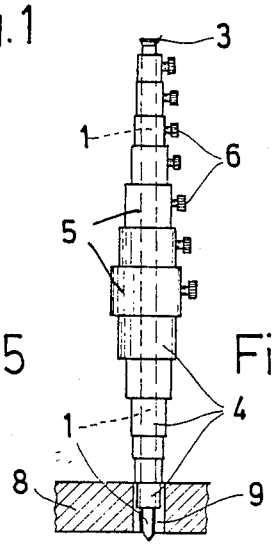
FIG. 5 shows a longitudinal side view of a second embodiment, in which the tip of the center punch is inserted into a small hole in the workpiece (without a tension band)
Figure 5A:
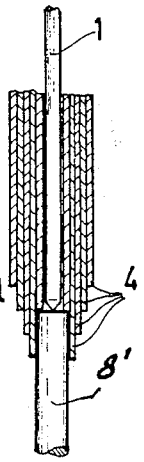
FIG. 5*a* shows a variant for centering on shafts or pins.
Figure 6:
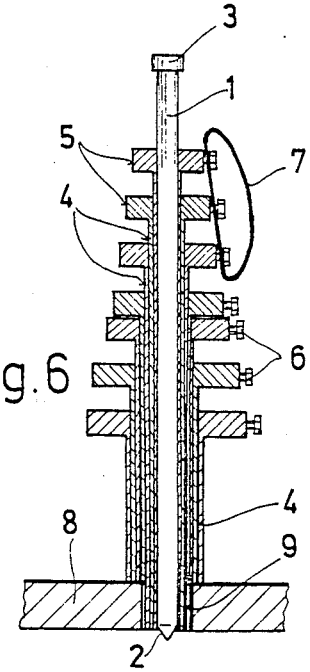
FIG. 6 shows a longitudinal section in which the tip of the center punch is inserted into a large hole in the workpiece (with tension band)

According to FIGS. 5 and 6, locking screws 6 whose heads project are mounted on the peripheries of the respective spacer sleeves 5. When the locking screws 6 are tightened, the spacer sleeves 5 with the hollow shafts 4 can be fixed to the center punch 1. According to FIG. 6, a rubber band 7 is placed, as a tension means, over some of the locking screws 6 and is intended to pull the spacer sleeves 5 together and to keep the hollow shafts 4 apart when the locking screws 6 have not been tightened. This makes it possible to prevent them from automatically falling away from the center punch 1 during center punching and to keep the tool in the ready position. In FIG. 6, the fourth hollow shaft 4 fits exactly into the hole 9, whereas the remaining larger hollow shafts rest on the workpiece 8. In FIG. 5, hole 9 is very small whereas in FIG. 6 it is several time larger. The other hollow shafts telescoped into one another lie in the lowermost hollow shaft. The center punch 1 or the tip 2 is located exactly in the center of the hole 9. The spacer sleeves 5 rest one on top of the other. In FIG. 5*a*, a hollow shaft 4 surrounds a shaft 8', and the top of the center punch 1 rests on the end of the said shaft, where center punching is carried out. The same is true when a pin is present instead of the shaft 8'. Two hollow shafts 4 resting on the workpiece 8 serve as a right-angled support which makes it more difficult for the workpiece to tilt.

The workpiece 8 may rest on another workpiece 10 shown in FIGS. 8, 9 and 11, and center marks in the form of conical depressions can be produced on the surface of the said workpiece 10 by means of blows on the center punch.

The tool can likewise be used for drawing or scribing lines exactly in the longitudinal center of slots or channels. The lower part of the tool with the center punch 1 and a suitable hollow shaft is simply inserted into the slot 9' or the channel 9'' of the shaft 8' or of the pin, the tip 2 automatically assuming precisely the longitudinal center position represented by dot-dash lines. Scribes 18 along the longitudinal center are formed in the slot or in the channel by moving the tool to and fro. The points of intersection of the scribes in the slots or channels indicate the crossing points exactly, as shown in FIG. 10. FIG. 10 also shows four holes 9 of different sizes, whose centers can be determined rapidly and precisely with the tool, to permit center punching to be carried out.

The distance adjuster 12 disclosed in FIG. 11 is used to produce, on the workpiece 8, a group of depressions the same distances apart. Two cross pieces 14, which can be fixed by means of the clamping screws 17 to allow the distance of the center punch 1 to be set exactly and secured, are displaceably fastened to the distance adjuster. If the tracing pin 16 is inserted into a notch produced beforehand by the center punch, the center punch 1 adopts a position a certain distance away from this notch. By repeating this process and inserting the tracing pin in each newly produced notch, a group of uniformly spaced depressions 11 can be produced by means of a conventional bore tool (FIG. 11*a*).

The tool described is particularly suitable for craftsmen such as mechanics, locksmiths, tool makers, joiners and amateur craftsmen who carry out work which involves determining the centers of holes or the longitudinal centers of slots and channels, shafts and pins, as well as the points of intersection of intersecting slots or channels. Drilling out broken screws without the danger of damage to the thread in the workpiece is possible because a precise center mark ca be made at the fracture point of the screw, the said center mark acting as an orientation aid for positioning the drill bit used.

I claim:

1. A tool comprising:

a slidable center punch having a tip for punching and scribing center lines in slots of working pieces;

a plurality of slidable hollow shafts including an innermost and an outermost shaft concentrically surrounding the center punch, the hollow shafts having respective lengths which are progressively shortened from the innermost shaft to the outermost shaft for effecting a stepwise decrease in respective outer diameters of the shafts toward respective ends of the center punch; and a plurality of spacer sleeves each provided for a corresponding shaft at an end thereof which is directed toward the end of the center punch not having the tip, the spacer sleeves having respective outer diameters which increase progressively in size from the spacer sleeve provided for the innermost shaft to the spacer sleeve provided for the outermost shaft for effecting a stepwise increase in the outer diameters of the spacer sleeves toward the tip of the center punch, such that the spacer sleeves can be compressed contiguously toward each other.

2. A tool as claimed in claim 1 wherein said spacer sleeves and said hollow shafts are separate pieces coupled to one another.

3. A tool as claimed in claim 1 wherein said spacer sleeves and said hollow shafts comprise corresponding parts connected to one another.

4. The tool as claimed in claim 1, further comprising:

a plurality of locking screws each provided for a corresponding one of the plurality of sleeves.

5. The tool as claimed in claim 1, further comprising:

tension means, placed over respective locking screws provided for the plurality of sleeves, for pulling the spacer sleeves contiguously toward each other.

6. The tool as claimed in claim 4, further comprising:

tension means, placed over the locking screws, for pulling the spacer sleeves contiguously toward each other.

* * * * *